US005975597A

United States Patent [19]

Makiuchi et al.

[11] Patent Number: 5,975,597

[45] Date of Patent: Nov. 2, 1999

[54] OUTSIDE HANDLE OF AUTOMOBILE SLIDING DOOR

[75] Inventors: Kazuya Makiuchi; Mamoru Nishihira; Kunihiko Hisamoto; Masaji Hirano, all of Sagamihara; Ryoichi Fukumoto, Nagoya; Morihito Nomura, Toyoake; Masakatsu Tsubouchi, Toyota, all of Japan

[73] Assignees: Aisin Seiki Kabushiki Kaisha, Kariya; Toyota Jidosha Kabushiki Kaisha, Toyota, both of Japan

[21] Appl. No.: 09/080,369

[22] Filed: May 18, 1998

[30] Foreign Application Priority Data

May 19, 1997 [JP] Japan ..... 9-144621

[51] Int. Cl.[6] ..... E05B 3/00

[52] U.S. Cl. ..... 292/336.3; 292/347; 74/105; 74/543

[58] Field of Search ..... 292/336.3, 347, 292/216, DIG. 23, DIG. 30; 74/105, 543

[56] References Cited

U.S. PATENT DOCUMENTS

| | | | |
|---|---|---|---|
| 3,993,338 | 11/1976 | Cherbourg et al. | 292/336.3 |
| 4,588,219 | 5/1986 | Kobayashi et al. | 292/336.3 |
| 4,898,413 | 2/1990 | Bertolini | 292/336.3 |
| 5,431,462 | 7/1995 | Lignell | 292/336.3 |
| 5,632,516 | 5/1997 | Schwab | 292/336.3 |

FOREIGN PATENT DOCUMENTS

| | | | |
|---|---|---|---|
| 105678 | 7/1963 | Denmark | 292/336.3 |
| 5-43165 | 10/1993 | Japan . | |
| 6-25568 | 7/1994 | Japan . | |
| 7-305539 | 11/1995 | Japan . | |
| 8-326366 | 12/1996 | Japan . | |

*Primary Examiner*—Steven Meyers
*Assistant Examiner*—Teri Pham
*Attorney, Agent, or Firm*—Burns, Doane, Swecker & Mathis, LLP

[57] ABSTRACT

An outside handle of a vehicular sliding door to open/close an opening of a vehicle body, having a bell crank portion which is formed into an L-shape having a first joint and a second joint at its leading ends and is turnably supported at its L-shaped bent portion on a the base portion through a crank pin. A fixed link is formed between the handle pin of the handle portion and the crank pin of the bell crank portion to construct a four-point link mechanism together with the handle portion, the sub-link portion and the bell crank portion.

6 Claims, 6 Drawing Sheets

OUTSIDE HANDLE OF AUTOMOBILE SLIDING DOOR

BACKGROUND OF THE INVENTION

The present invention relates to an outside handle adapted to be used with a sliding door for opening/closing an opening formed in an automobile body.

An outside handle of the prior art for a sliding door attached to a side of an automobile body includes a handle portion, a base portion, a bell crank portion and a sub-link portion (or an output lever portion), and is jointed to a door lock mechanism by an open rod (or a lock side link) attached to the bell crank portion.

If the conventional outside handle of the sliding door is constructed such that the handle portion is pulled outward of the vehicle, the center of rotation of the bell crank portion has to be arranged on the outer side of the door glass, because of a frame of the door glass. Thus, there is a problem that the sliding door has a large thickness. In order to solve this problem, there has been conceived a structure in which a functional portion such as the bell crank portion is small-sized. However, this structure has failed to make a sufficient improvement in the stroke efficiency at the beginning of the operation of the handle portion.

In the case of a structure in which the handle portion is pulled outward of the vehicle, a balance weight is attached to the bell crank portion so as to return the handle portion to the original position. This balance weight is arranged on a bracket at a more outer side than the door glass of the sliding door.

The outside handle is a structural member for pulling the handle portion outward of the vehicle and is desired to ensure the unlocking action reliably with a lighter force to pull the handle portion outward of the vehicle so as to improve the operability of the handle portion.

In the structure in which the handle portion is pulled outward of the vehicle, there arises a problem that the sliding door is necessarily thickened if the pin at the L-shaped bent portion of the bell crank portion is arranged at a more outer side than the door glass.

Even if the bell crank portion is positioned as closer as possible to the door glass thereby to thin the sliding door, therefore, there is a problem that the vertical motions of the door glass are deteriorated if the bell crank portion is excessively close to the door glass.

In order to light the force to operate the outside handle, i.e., the handle portion of the outside handle outward of the vehicle, on the other hand, the length of the handle portion has to be made larger in the direction of the base portion than the pin of the handle portion. If the handle portion of the outside handle is elongated, however, the distance from the glass end to the door end is enlarged from the positional relation to the door glass guide frame so that the glass is relatively narrowed to change the appearance of the automobile drastically.

If the length from the pin of the bell crank portion to the sub-link portion is enlarged to elongate the handle portion, on the other hand, the pulling allowance of the handle portion is enlarged transversely of the vehicle to deteriorate the operability. It has therefore been desired to improve the operability of the handle portion without changing the length of the same.

If the balance weight is arranged as in the prior art at a more outer side of the vehicle than the door glass of the sliding door, moreover, there is a problem that the thickness of the door is enlarged.

In the structure in which the handle portion is pulled outward of the vehicle, there is a problem that a force to return the handle portion inward of the vehicle even if the force to pull it is weakened. In an outside handle of a four-link type, on the other hand, there is a problem that the operation load grows higher as the handle portion is operated.

SUMMARY OF THE INVENTION

The invention has an object to provide an outside handle of a vehicle sliding door, which can solve the above-specified problems.

According to a first aspect of the invention, there is provided an outside handle for use in a vehicular sliding door for sliding to open/close an opening of a vehicle body, comprising: a base portion adapted to be mounted on the sliding door: a handle portion supported turnably on said base portion an L-shaped bell crank portion pivoted on the base portion; and a sub-link portion pivotally jointed between the handle portion and the bell crank portion, said handle portion being turnably supported at its one end on said base portion through a pin and turnably jointed to one end of the sub-link portion, said sub-link portion being turnably jointed at its other end to a first joint of said bell crank portion, said bell crank portion being formed into an L-shape having a first joint and a second joint at its leading ends and being turnably supported at its L-shaped bent portion on said base portion through a crank pin, the second joint being formed to be turnably jointed to an open rod adapted to release a door lock mechanism when the handle portion is pulled outward of the vehicle.

According to further aspect of the invention, in the first aspect, a first distance between an instantaneous center of the outside handle and the bell crank portion and the joint point of the handle portion and a second distance between the instantaneous center and the link joint point of the bell crank portion are so set that the first distance is larger than the second distance when the handle portion is at an initial position and that the first distance and the second distance are substantially equalized when the handle portion is at the maximum position.

According to another aspect of the invention, there is provided a vehicular sliding door adapted to open/close an opening of a vehicle body, comprising: a base portion secured to a body of said sliding door: a handle portion supported turnably on said base portion for releasing a door lock mechanism when pulled outward of the vehicle; a sub-link portion; and an L-shaped bell crank portion, said handle portion being turnably supported at its one end on said sliding door and turnable at its other end with respect to said base portion and being turnably jointed to one end of the sub-link portion which is turnably jointed between said handle portion and said bell crank portion, said sub-link portion being turnably jointed at its other end to a first joint of said bell crank portion, said bell crank portion being formed into an L-shape having a first joint and a second joint at its leading ends and being turnably supported at its L-shaped bent portion on said base portion through a crank pin and turnably jointed at its second joint to an open rod which is connected said door lock mechanism, said crank pin being equipped with a turn biasing member and a balance weight which is arranged at a more inner side of said door glass between said bell crank portion and said turn biasing member.

DESCRIPTION OF THE PREFERRED EMBODIMENTS

Figure 1:
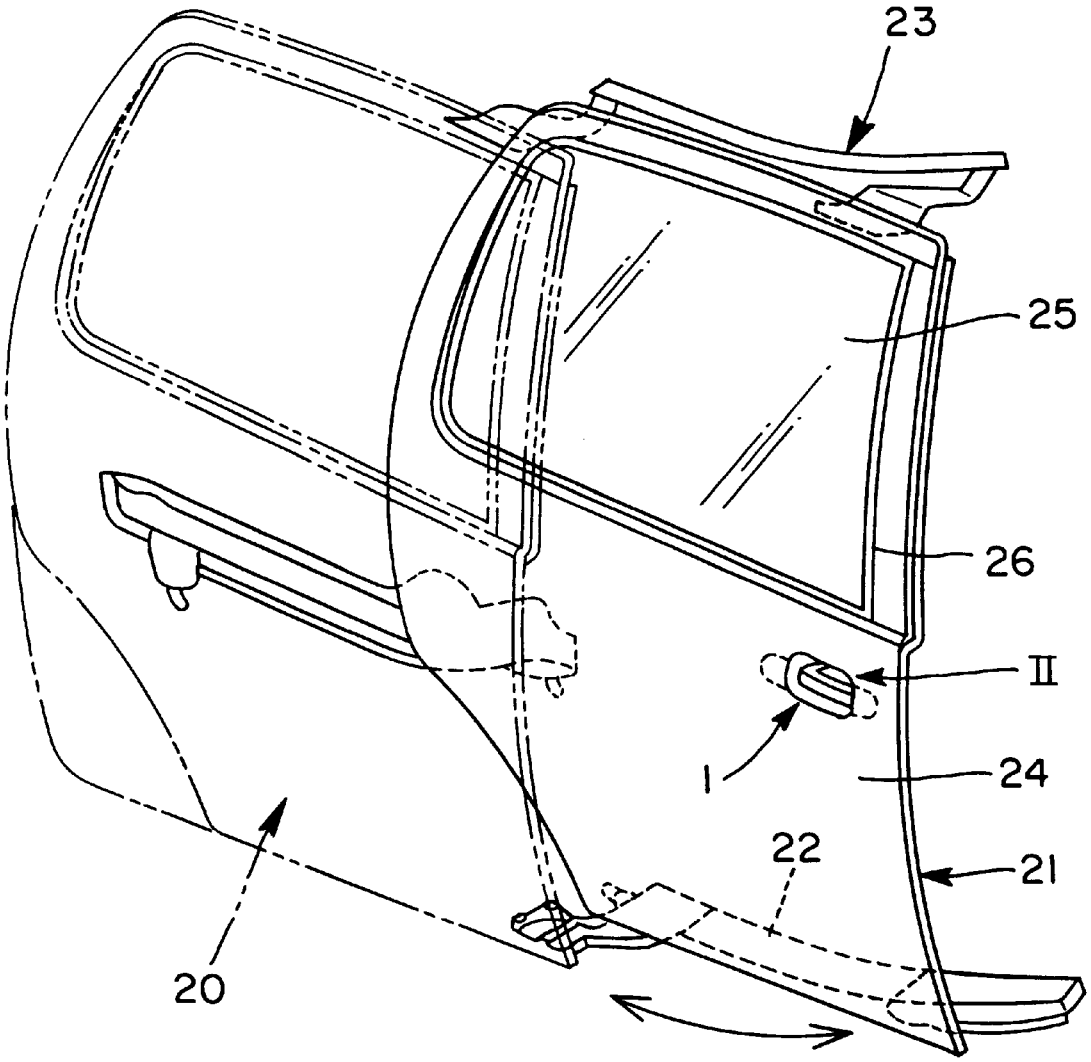
FIG. 1 is a perspective view showing an embodiment of the invention and the state of a sliding door and an automobile body, in which the sliding door is being opened/closed.
Figure 2:
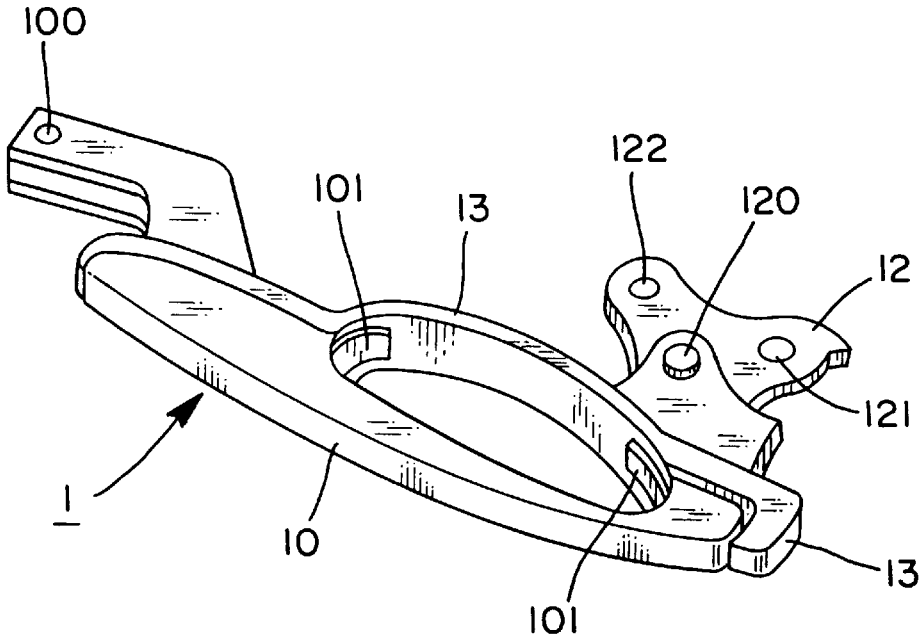
FIG. 2 is a perspective view of an outside handle and shows a portion II of FIG. 1 in an enlarged scale.

The invention will be first described in connection with its embodiment with reference to: FIG. 1 showing the opening/closing state of a sliding door with respect an automobile body.

Reference numeral 24 designates a sliding door adapted to be used for a body 20 of a wagon type automobile as an embodiment of the invention. Numeral 21 designates a space corresponding to an opening of the automobile, which is formed at the right-hand side face of the automobile body 20 to admit "go in and out" of a passenger and a parcel therethrough. This opening 21 may be in any portion of the automobile body 20 other than the side face if the passenger or parcel can go in and out therethrough. Numeral 22 designates a lower guide rail, and numeral 23 designates an upper guide rail. In the automobile body, the lower guide rail 22 is mounted along the lower side of the opening 21 whereas the upper guide rail 23 is mounted along the upper side of the opening 21. The sliding door 24 is attached to the lower guide rail 22 and the upper guide rail 23 to be opened/closed along the side face of the automobile body 20.

Numeral 1 designates an outside handle. This outside handle 1 is mounted on the sliding door 24 which is attached to the opening 21 of the automobile body 20 that it may be opened/closed along the opening 21. Numeral 25 designates a door glass of the sliding door 24. Numeral 26 designates a door glass guide frame of the door glass 25.

Figure 3:
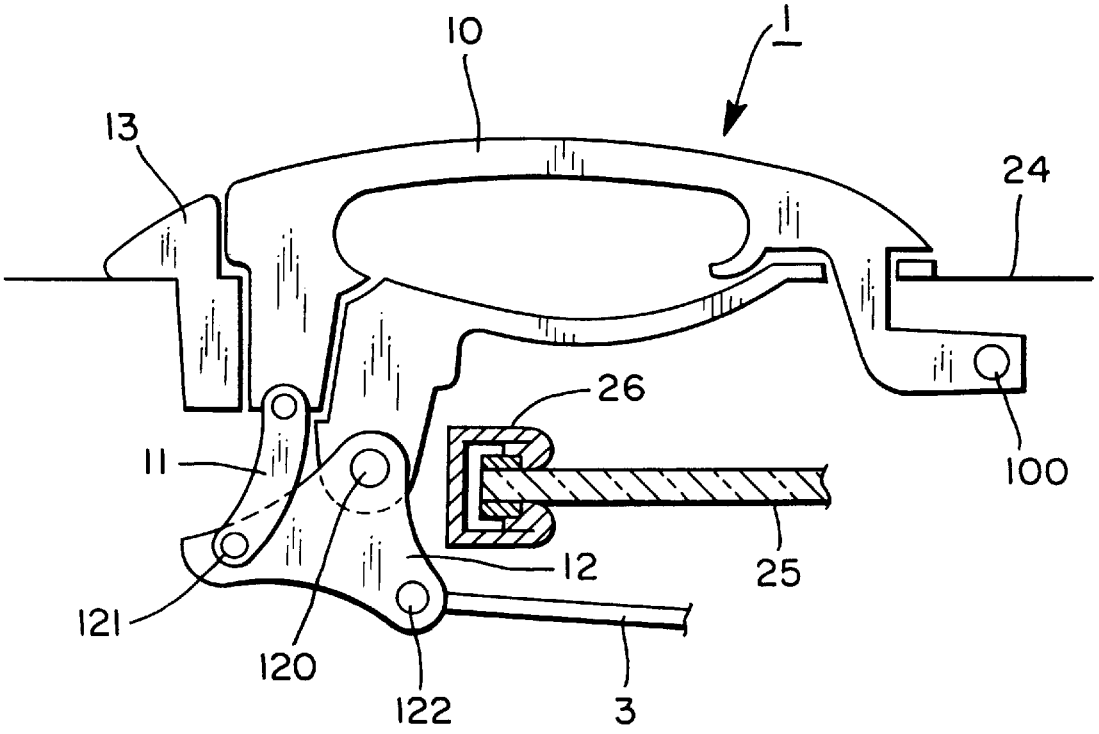
FIG. 3 is an explanatory top plan view showing an outside handle according to a first embodiment of the invention.

As shown in FIG. 3, the outside handle 1, according to a first embodiment of the invention is constructed to include a handle portion 10, a sub-link portion (or an output lever portion) 11, an L-shaped bell crank portion 12 and a base portion 13.

The handle portion 10 is hinged at its one end to the sliding door 24 by a handle pin 100 and is turnably jointed and supported at its other end to and on the base portion 13. Moreover, the handle portion 10 is turnably jointed to one end of the sub-link portion 11 and further to the bell crank portion 12 through the sub-link portion 11.

The sub-link portion 11 is turnably jointed at its one end to the handle portion 10 and at its other end to the bell crank portion 12.

This bell crank portion 12 is formed into an L-shape having a first joint 121 and a second joint 122 at its two respective leading ends and is turnably supported at its corner (or the curved center) of the L-shape on the base portion 13 through a crank pin 120 having a vertical axis. The door glass guide frame 26 is extended along the ascending/descending locus of the door glass 25 to the lower portion of the sliding door 24. The crank pin 120 is mounted at the side opposed to the door glass with respect to the door glass guide frame 26, that is, at the back side of the door glass guide frame 26.

The bell crank portion 12 is turnably jointed at its first joint portion 121 to one end of the sub-link portion 11 and at its second joint 122 to an open rod (or a lock side link) 3. This open rod 3 is arranged at the inner position of the door glass 25 and is jointed to the not-shown door locking mechanism.

The base portion 13 is fixed on the sliding door 24.

Figure 4:
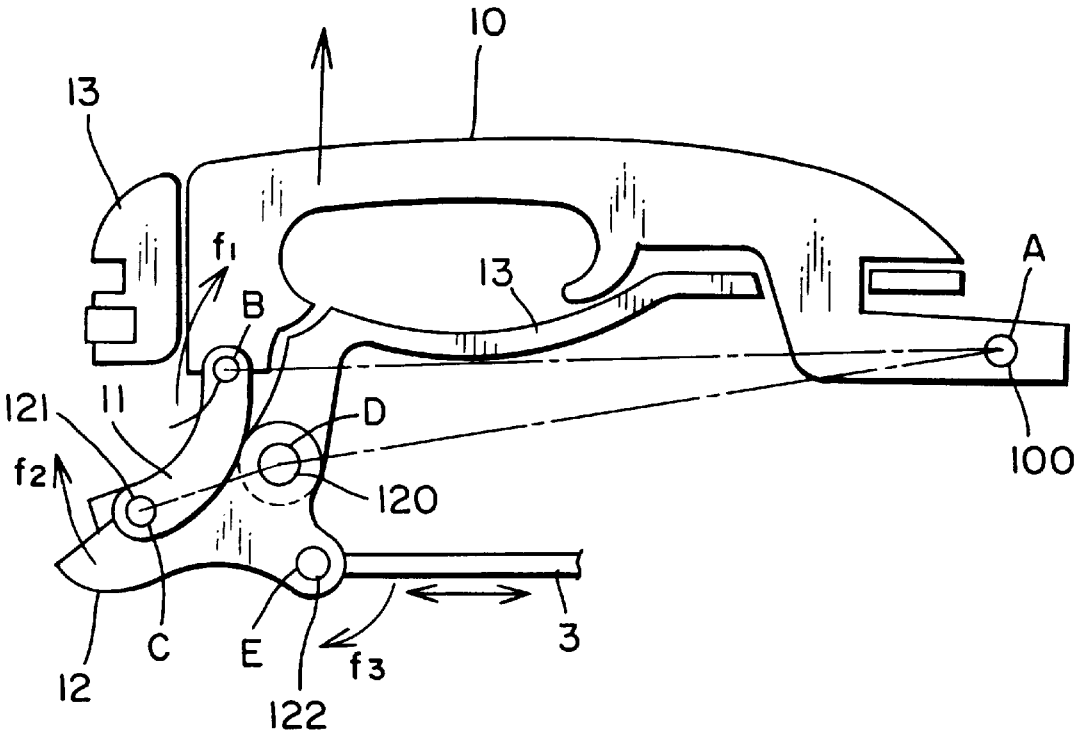
FIG. 4 is an explanatory top plan view showing a four-point link mechanism of the outside handle of the invention.

Here will be described the operation of the first embodiment. As the handle portion 10 of the outside handle 1 is pulled outward of the vehicle, the first joint 121 of the bell crank portion 12, to which the sub-link portion 11 is turnably jointed, is pulled through the sub-link portion 11 so that the bell crank portion 12 is turned on the crank pin 120. At this time, the crank pin 120 of the bell crank portion 12 is arranged at the position opposed to the door glass with respect to the door glass guide frame 26, and the second joint 122 of the bell crank portion 12 is positioned at the inner side of the door glass 25 and the door glass guide frame 26. As a result, as the bell crank portion 12 is turned, its second joint 122 is pulled at the inner position of the door glass toward the door glass guide frame, so that the open rod 3 is pulled toward the door glass guide frame to open the door lock, The actions of the embodiment will be described with reference to FIGS. 4, 5 and 6.

The handle portion 10 is turnably jointed and supported at its one end to and on the base portion 13 through the handle pin 100. Moreover, the handle portion 10 is turnably jointed to one end of the sub-link portion 11 and further to the bell crank portion 12 through the sub-link portion 11.

This sub-link portion 11 is turnably jointed at its one end to the handle portion 10 and at its other end to the bell crank portion 12.

This bell crank portion 12 is formed into an L-shape and is turnably supported at its L-shaped bent portion on the sliding door 24 through the crank pin 120. The bell crank portion 12 is turnably jointed at its first joint 121 to one end of the sub-link portion 11 and at its second joint 122 to the open rod 3.

The base portion 13 is fixed on the sliding door 24.

Figure 5:
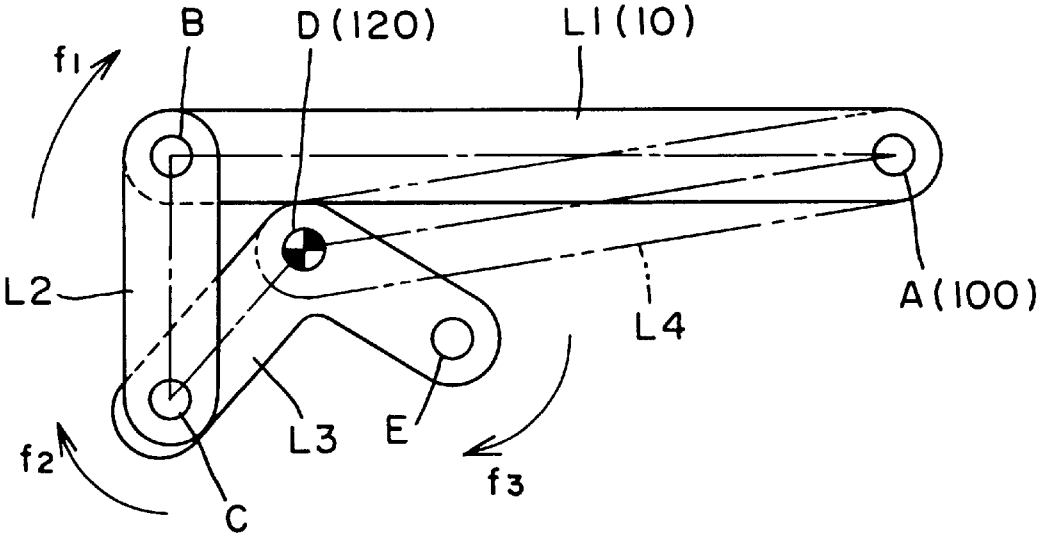
FIG. 5 is an explanatory diagram showing a four-point link mechanism of the same outside handle.

The actions of the individual portions of the outside handle 1 will be described as those of a four-point link mechanism, as shown in FIG. 5. The handle pin 100 is located at point A; the point jointing the handle portion 10 and the sub-link portion 11 turnably is located at point B; the point jointing the sub-link portion 11 and the bell crank portion 12 turnably is located at point C; the crank pin 120 of the bell crank portion 12 is located at point D; and the point jointing the bell crank portion 12 and the open rod 3 is located at point E. If the lever AB is assumed as a first link L1, the lever BC as a second link L2, the lever CD as a third link L3 and the lever DA as a fourth link L4, there is established the four-point link mechanism. In this four-point link mechanism, only the fourth link L4 assuming the lever DA is fixed, whereas the first link L1, the second link L2 and the third link L3 are individually movable.

Arrow f1 indicates the motion of point B, i.e., the motion of the handle portion 10 outward of the vehicle. Arrow f2 indicates the motion of point C. Arrow f3 indicates the motion of point E.

When the handle portion 10 of the outside handle 1 is pulled outward of the vehicle to unlock the sliding door 24, as shown in FIG. 5, the first link L1 corresponding to the handle portion 10 is moved in the direction f1. In accordance with the motion of the first link L1, the second link L2 corresponding to the sub-link portion 11 is moved in the direction f2. Simultaneously with this, the point E corresponding to the other end 122 of the bell crank portion 12 is moved in the direction f3 to pull the open rod 3 so that the sliding door 24 is unlocked.

Figure 6:
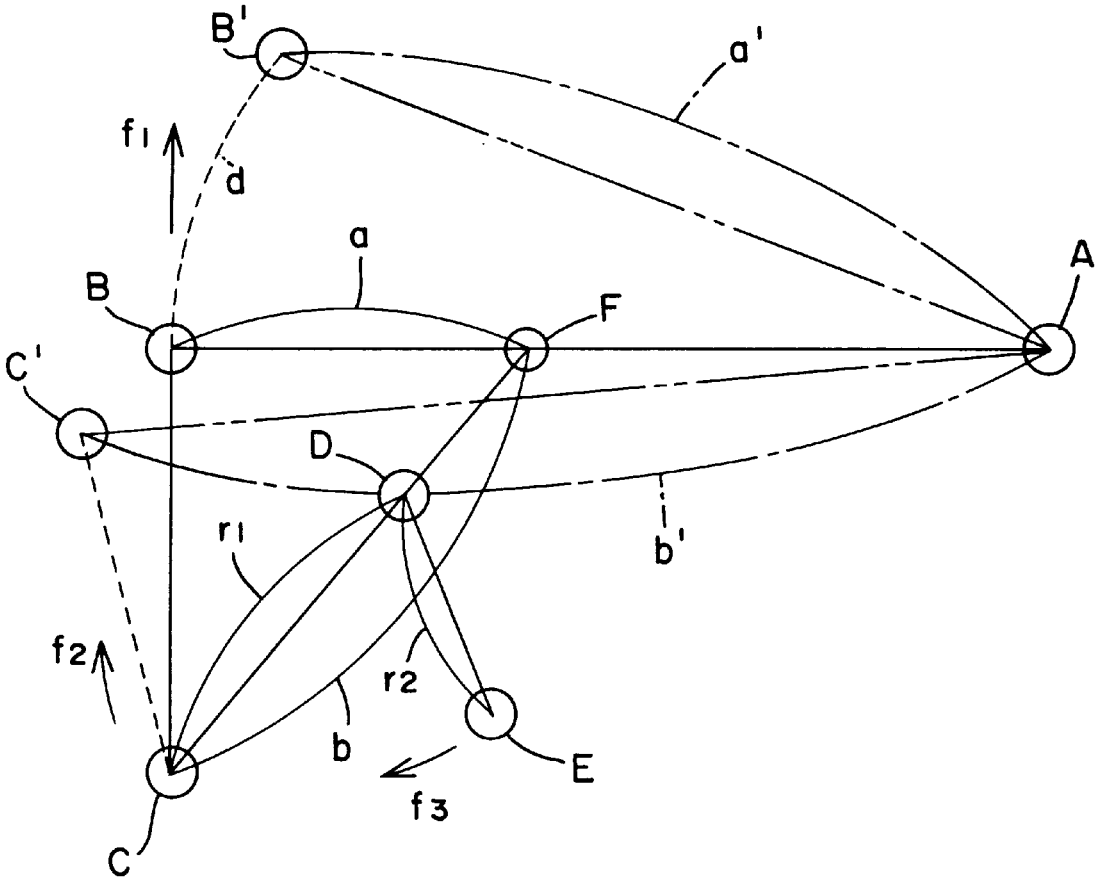
FIG. 6 is an explanatory diagram for explaining the force actions of the same four-point link mechanism.

A further description will be made with reference to FIG. 6 presenting an explanatory diagram showing the force actions of the four-point link mechanism. In FIG. 6, a virtual intersection between the extension of the third link L3 at the side or the point D and the first link L1 is designated by an instantaneous center point F. Let it be assumed that the segment between the instantaneous center point F and the point B has a length a, the segment between the instantaneous center point F and the point C has a length b, the segment between the points C and D has a length r1, and the segment between the points D and E has a length r2. The force f1 to pull the handle portion 10 on the handle turning axis A outward of the vehicle and the force f3 to pull the open rod 3 at the point E relating to the unlocking action have relations, as expressed by the following formulae;

$$f1\times a=f2\times b\rightarrow f2=a/b\times f1;$$

$$f3\times r2=f2\times r1\rightarrow f3=r1/r2\times f1;$$

and $$f3=r1/r2\times a/b\times f1=r1/b\times a/r2\times f1.$$

As the length r1 is enlarged, therefore, the ratio of r1/b takes a larger numerical value. If the force f3 to pull the open rod 3 at the point E relating to the unlocking action is unvaried, therefore, the force f1 to pull the handle portion 10 outward of the vehicle can be reduced. As a result, the load efficiency to pull the handle portion 10 is enhanced as the pulling action proceeds, because of b>a at the beginning of the pulling action of the outside handle but b'≈a' at the end of the pulling action. As a result, the action load can be reduced without changing any action stroke (or pulling allowance) of the handle portion.

Figure 7:
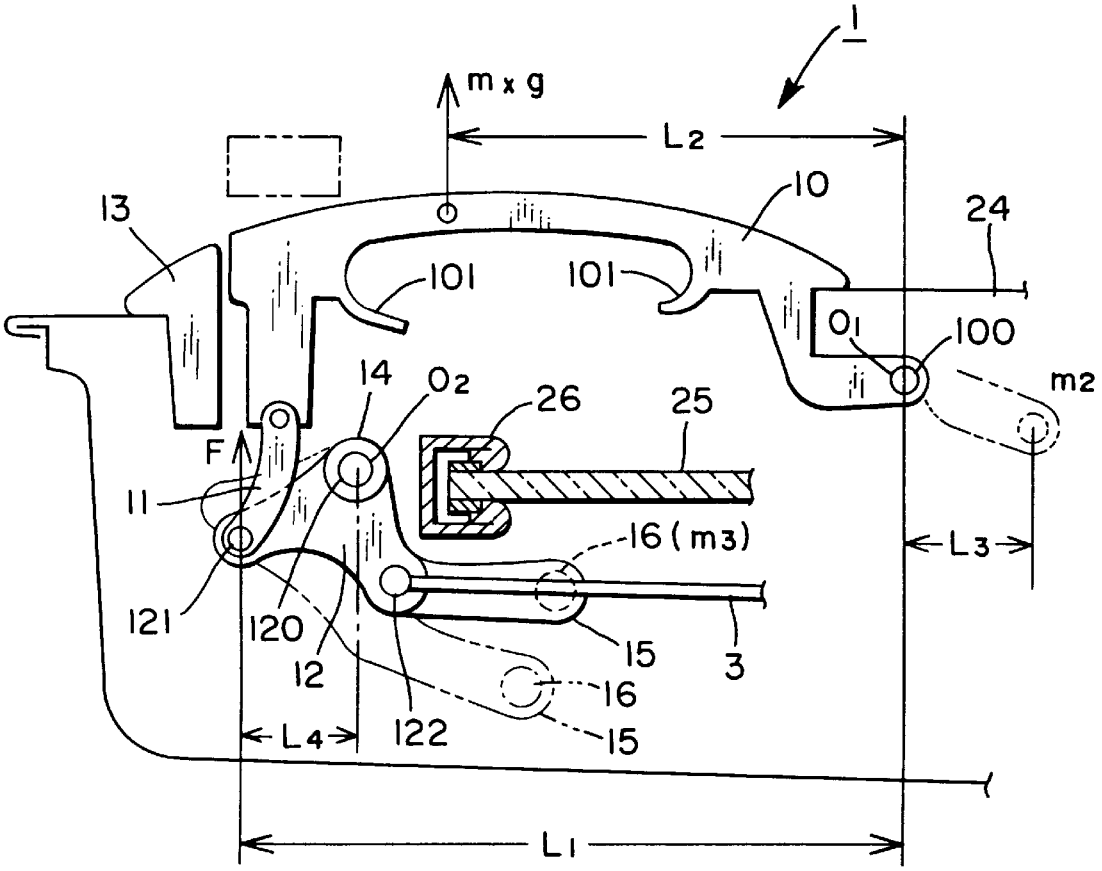
FIG. 7 is an explanatory top plan view showing an outside handle according to a third embodiment of the invention.
Figure 8:
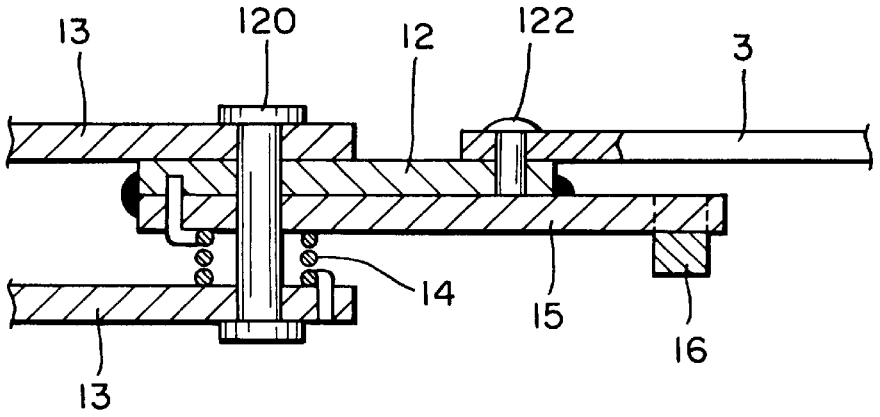
FIG. 8 is a cross section showing a construction about a pin passing through a base portion.
Figure 9:
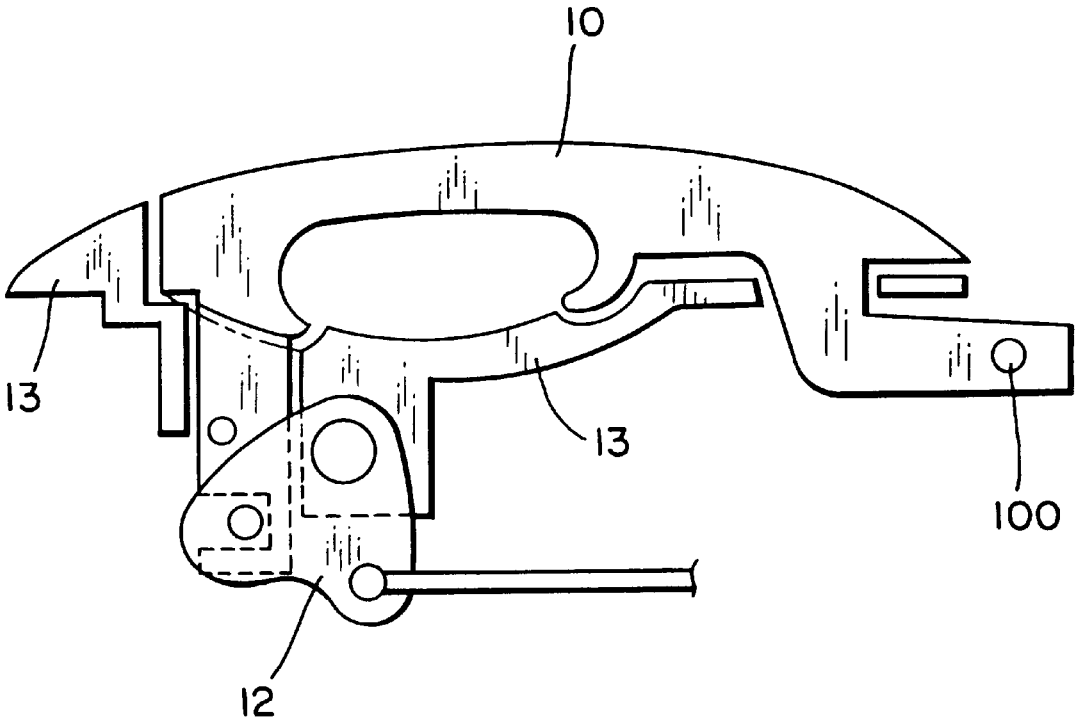
FIG. 9 PRIOR ART
FIG. 9 is a top plan view showing an outside handle of the prior art.

The invention will be further described with reference to FIG. 7 presenting an enlarged top plan view for explaining a bell crank portion of an outside handle 1 according to a second embodiment.

This outside handle 1 is mounted on the sliding door 24 which is so attached to the opening of the automobile body that it may be opened/closed along the opening, Numeral 25 designates a door glass of the sliding door 24. Numeral 26 designates a door glass guide frame of the door glass 25.

The outside handle 1, as shown in FIG. 7, according to the second embodiment of the invention is constructed to include the handle portion 10, the sub-link portion 11, the L-shaped bell crank portion 12, the base portion 13, a spring 14 or an elastic member, a bracket 15 and a balance weight 16.

The handle portion 10 is turnably jointed and supported at its one end to and on the sliding door 24 through the handle pin 100. Moreover, the handle portion 10 is turnably jointed to one end of the sub-link portion 11 and further to the bell crank portion 12 through the sub-link portion 11.

The sub-link portion 11 is turnably jointed at its one end to the handle portion 10 and at its other end to the bell crank portion 12.

The bell crank portion 12 is formed into an L-shape and is turnably supported at its L-shaped bent portion on the sliding door 24 through the crank pin 120 having the vertical axis. The crank pin 120 is mounted, at the back side of the door glass guide frame 26, that is, at the side opposed to the door glass with respect to the door glass guide frame 26. The bell crank portion 12 is turnably jointed at its first joint portion 121 of the L-shape to one end of the sub-link portion 11 and at its second joint 122 of the L-shape to the open rod 3, and this open rod 3 is arranged at the inner position of the door glass 25.

The base portion 13 is fixed on the sliding door 24. As a result, the longitudinal distance (L4) between the first joint 121 and a point O2 becomes larger as the handle portion 10 is pulled, so that the handle portion 10 takes no interference with the door glass 25.

The spring 14 or the turn biasing member is made of a coiled wire wound around the crank pin 120, to bias the bell crank portion 12 on the crank pin 120 toward the initial position of the handle portion 10, i.e., the handle portion 10 inward of the vehicle.

A bracket 15 is positioned inside of the door glass 25 and is fixedly interposed at its one end between the spring 14 and the bell crank portion 12 and equipped at its other inner end with the balance weight 16. The bracket 15 is caused to act against the inertial force, as directed outward of the vehicle, of the mass of the handle portion 10 by the mass of the balance weight 16 positioned inside of the vehicle.

Here will be described the actions of the second embodiment. As the handle portion 10 of the outside handle 1 is pulled outward of the vehicle, the first joint 121 of the bell crank portion 12, to which the sub-link portion 11 is turnably jointed, is pulled through the sub-link portion 11 so that the bell crank portion 12 is turned about the crank pin 120. At this time, the crank pin 120 of the bell crank portion 12 is arranged at the rear side of the door glass guide frame 26, and the second joint 122 of the bell crank portion 12, the bracket 15 and the balance weight 16 are positioned at the inner side of the door glass 25 and the door glass guide frame 26.

When an operator's hand is released from the handle portion after the handle portion 10 is pulled outward of the vehicle to open the sliding door 24, the bell crank portion 12 is returned toward the initial position of the handle portion 10 by the actions of the biasing force of the spring 14, and the masses of the bracket 15 and the balance weight 16.

Here will be described the reason why the balance weight 16 is mounted on the bracket 15 attached to the bell crank portion 12, as shown in FIG. 7.

The angular moment M1 of the handle pin 100 (at O1) is expressed by the following formula in which a force of m×g (m is a weight of the handle portion) to pull the handle portion 10 outward of the vehicle is multiplied by L2, and takes a relatively large value. It is, therefore, necessary to make a weight m2 heavy to be attached to the handle pin 100. In short, M1=m×g×L2→ increases to make the weight m2 heavy.

According to the second embodiment of the invention, on the other hand, the angular moment M2 of the crank pin 120 (at O2) or the bell crank portion 12 is expressed by the following formula. A force F to act on the first joint 121 of the bell crank portion 12 is expressed by the following formula: F=m×g×L2/L1. The angular moment M2 of the crank pin 120 (at O2) of the bell crank portion 12=F×L4=

$(m \times g \times L2/L1) \times L4 = M1 \times (L4/L1) \rightarrow$ relatively small. Thus, a weight m3 may be light, Even when the handle portion is pulled outward of the vehicle to open the sliding door, according to the fourth embodiment of the invention, the finger an be prevented from being pinched between the finger push portion and the inner side wall of the vehicle because the finger push portion at the opposite side of the pin has the inner wall face.

It is possible to thin the sliding door which is equipped with the outside handle for opening the door lock by pulling the outside handle outward of the vehicle. Moreover, the size from the door glass guide frame to the end portion of the sliding door can be reduced to narrow the pillar portion, In the sliding door having the outside handle for opening the door lock by pulling the outside handle outward of the vehicle, the door glass can be smoothly moved up and down.

In addition, the operability of the handle portion of the outside handle to the outside of the vehicle is improved, Specifically, the handle portion of the outside handle can be operated outward of the vehicle with a lighter force without changing the length of the handle portion. As a result, the handle portion of the outside handle can be operated with a lighter force without changing the exterior design.

In the sliding door having the outside handle for opening the door lock by pulling the outside handle outward of the vehicle, moreover, there is achieved an effect that the handle portion is easily returned to the initial position if the force to pull the handle portion outward of the vehicle is eliminated.

As many apparently widely different embodiments of the present invention can be made without departing from the spirit and scope thereof, it is to be understood that the invention is not limited to the specific embodiments thereof except as defined in the appended claims.

What is claimed is:

1. An outside handle mounted on a vehicular sliding door that is adapted to slide to open/close an opening of a vehicle body, comprising: a base portion mounted on the sliding door, the sliding door being provided with a door glass and a door glass guide frame for the door glass; a handle portion supported turnably on said base portion; an L-shaped bell crank portion pivoted on the base portion; and a sub-link portion pivotally jointed between the handle portion and the bell crank portion, said handle portion having one end that is turnably supported on said sliding door through a pin and said handle portion being turnably jointed to one end of the sub-link portion at a first joint portion, said sub-link portion being turnably jointed at its other end to a first joint of said bell crank portion at a second joint point, said bell crank portion having leading ends and an L-shaped bent portion, said bell crank portion having the first joint and a second joint at its leading ends and being turnably supported at its L-shaped bent portion on said base portion through a substantially vertically arranged crank pin, the second joint being turnably jointed to an open rod adapted to release a door lock mechanism when the handle portion is pulled outward of the vehicle, said crank pin being positioned opposite to the door glass with respect to the door glass guide frame, and said open rod being located inwardly of said door glass.

2. An outside handle according to claim 1, wherein said base portion functions as a fixed link formed between the pin of said handle portion and the crank pin of said bell crank portion to produce a four-point link mechanism together with said handle portion, said sub-link portion and said bell crank portion.

3. An outside handle according to claim 1, further comprising means for lightening a force to pull said handle portion outward of the vehicle without changing a force to unlock said sliding door and the length of said handle portion.

4. An outside handle according to claim 3, wherein said means is a four-point link mechanism which is composed of said base portion, said handle portion, said sub-link portion and said crank portion.

5. An outside handle of a vehicular sliding door according to claim 2, wherein a first distance between an instantaneous center of said outside handle and said bell crank portion and the second joint point of said sublink portion and a second distance between said instantaneous center and the first joint portion of said handle portion are so set that said first distance is larger than said second distance when said handle portion is at an initial position and that said first distance and said second distance are substantially equalized when said handle portion is at a maximum position.

6. A vehicular sliding door adapted to open/close an opening of a vehicle body, comprising: a base portion secured to a body of said sliding door, said sliding door being provided with a door glass and a door glass guide frame for the door glass; a handle portion supported turnably on said base portion for releasing a door lock mechanism when pulled outward of the vehicle; a sub-link portion; and an L-shaped bell crank portion, said handle portion having one end turnably supported on said sliding door and an opposite end turnable with respect to said base portion and being turnably jointed to one end of the sub-link portion which is turnably jointed between said handle portion and said bell crank portion, said sub-link portion being turnably jointed at another end to a first joint of said bell crank portion, said bell crank portion having leading ends and an L-shaped bent portion, said bell crank portion having the first joint and a second joint at its leading ends and being turnably supported at its L-shaped bent portion on said base portion through a crank pin and turnably jointed at its second joint to an open rod which is connected to said door lock mechanism, said open rod being located inwardly of said door glass, said crank pin being positioned opposite to the door glass with respect to the door glass guide frame, said crank pin being equipped with a turn biasing member and a balance weight which is arranged at an inner side of said door glass between said bell crank portion and said turn biasing member.

* * * * *